US009393816B2

(12) United States Patent
Takabatake et al.

(10) Patent No.: US 9,393,816 B2
(45) Date of Patent: Jul. 19, 2016

(54) PRINTER

(71) Applicant: FUJITSU COMPONENT LIMITED, Tokyo (JP)

(72) Inventors: Yoshinari Takabatake, Tokyo (JP); Masahiro Tsuchiya, Tokyo (JP); Yukihiro Mori, Tokyo (JP); Sumio Watanabe, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/132,075

(22) Filed: Dec. 18, 2013

(65) Prior Publication Data

US 2014/0186088 A1 Jul. 3, 2014

(30) Foreign Application Priority Data

Dec. 28, 2012 (JP) ..... 2012-288539

(51) Int. Cl.

| | |
|---|---|
| ***B41J 11/00*** | (2006.01) |
| ***B41J 11/66*** | (2006.01) |
| ***B41J 11/70*** | (2006.01) |
| ***B26D 1/08*** | (2006.01) |
| *B26D 5/00* | (2006.01) |
| *B26D 5/06* | (2006.01) |

(52) U.S. Cl.

CPC ..... *B41J 11/66* (2013.01); *B26D 1/085* (2013.01); *B41J 11/70* (2013.01); *B26D 5/005* (2013.01); *B26D 5/06* (2013.01)

(58) Field of Classification Search

CPC ..... B41J 3/4075; B41J 3/39; B41J 11/70; B41J 11/706; B41J 11/703; B26D 1/02; B26D 1/08; B26D 2007/005; B65H 35/0086; B65H 35/06; B65H 2301/51532; B65H 2301/515326

USPC ..... 400/648, 649, 659, 611

See application file for complete search history.

(56) References Cited

U.S. PATENT DOCUMENTS

| | | | | |
|---|---|---|---|---|
| 5,974,930 | A * | 11/1999 | Longrod | 83/629 |
| 6,814,515 | B2 | 11/2004 | Tsuchiya et al. | |
| 7,547,153 | B2 * | 6/2009 | Yoshioka | 400/621 |
| 7,857,534 | B2 | 12/2010 | Watanabe et al. | |
| 7,876,346 | B2 * | 1/2011 | Watanabe et al. | 347/222 |
| 2002/0020273 | A1 | 2/2002 | Nomura et al. | |
| 2011/0236117 | A1 * | 9/2011 | Tsuchiya et al. | 400/621 |

FOREIGN PATENT DOCUMENTS

| | | |
|---|---|---|
| CN | 1263500 | 8/2000 |
| JP | 10-052956 | 2/1998 |
| JP | 2003-019845 | 1/2003 |
| JP | 2007-130842 | 5/2007 |

* cited by examiner

*Primary Examiner* — Matthew G Marini
(74) *Attorney, Agent, or Firm* — IPUSA, PLLC

(57) ABSTRACT

A printer includes a print head that prints information on a recording medium, a fixed blade, a sliding mechanism that is slidable relative to the fixed blade, a movable blade that moves according to the sliding movement of the sliding mechanism, and a cutter driving part that causes the sliding mechanism to slide to move the movable blade.

14 Claims, 16 Drawing Sheets

PRINTER

CROSS-REFERENCE TO RELATED APPLICATION

The present application is based upon and claims the benefit of priority of Japanese Patent Application No. 2012-288539, filed on Dec. 28, 2012, the entire contents of which are incorporated herein by reference.

BACKGROUND OF THE INVENTION

1. Field of the Invention

An aspect of this disclosure relates to a printer.

2. Description of the Related Art

Printers for printing receipts are widely used, for example, for cash registers in shops and stores, and for automated teller machines (ATM) and cash dispensers (CD) in banks. In such a printer, for example, information is printed by a thermal head on recording paper (thermal paper) while the recording paper is being fed, and the recording paper is cut with a cutter at a predetermined length, i.e., after the predetermined length of the recording paper is fed.

A cutter of such a printer typically includes a movable blade and a fixed blade. The movable blade is moved toward the fixed blade by, for example, a motor, and recording paper is cut by the fixed blade and the movable blade. To linearly move the movable blade, a gear box for transmitting the driving force of the motor is necessary. Such a gear box is generally provided on a side of a printer (see, for example, Japanese Laid-Open Patent Publication No. 2003-19845, Japanese Laid-Open Patent Publication No. 2007-130842, and Japanese Laid-Open Patent Publication No. 10-52956).

Here, with a configuration where a gear box for driving a movable blade is provided on a side of a printer, it is difficult to reduce the width of a part of the printer from which recording paper is ejected. Accordingly, there is a demand for a technology that makes it possible to reduce the width of a printer in the width direction of recording paper and to reduce the size of a printer.

SUMMARY OF THE INVENTION

In an aspect of this disclosure, there is provided a printer including a print head that prints information on a recording medium, a fixed blade, a sliding mechanism that is slidable relative to the fixed blade, a movable blade that moves according to the sliding movement of the sliding mechanism, and a cutter driving part that causes the sliding mechanism to slide to move the movable blade.

DESCRIPTION OF EMBODIMENTS

Embodiments of the present invention are described below with reference to the accompanying drawings. The same reference number is assigned to the same component throughout the accompanying drawings, and overlapping descriptions of the same component are omitted.

<Configuration of Printer>

Figure 1:
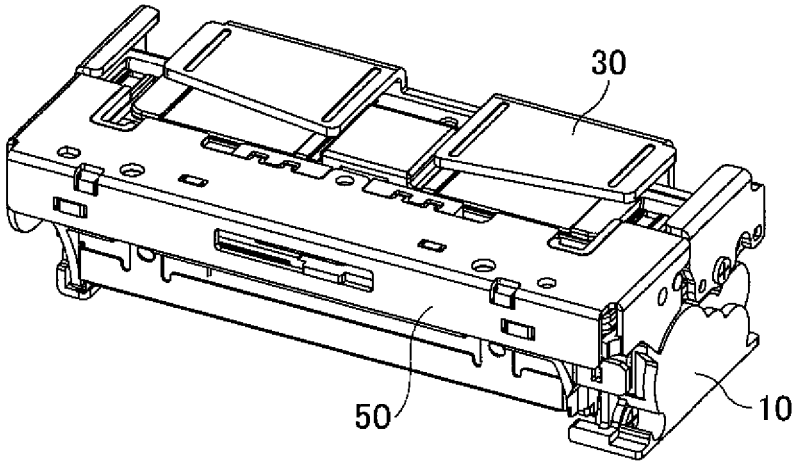
FIG. 1 is a perspective view (1) of a printer.
Figure 2:
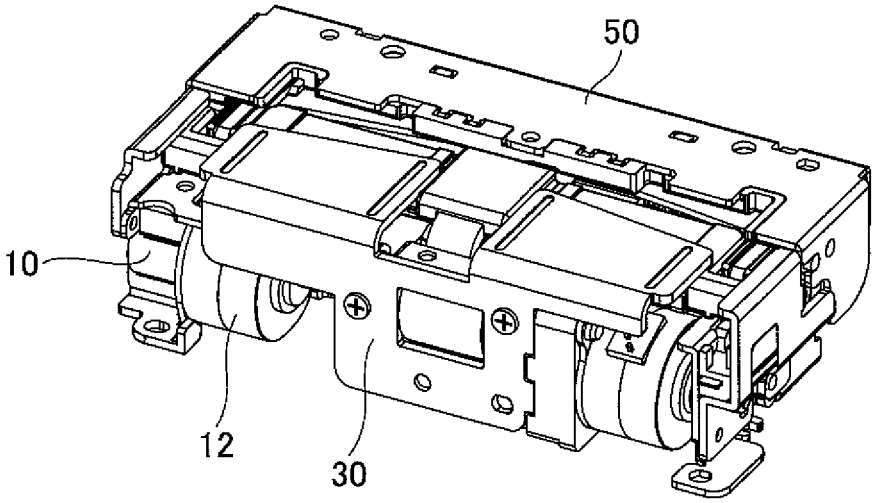
FIG. 2 is a perspective view (2) of a printer.
Figure 3:
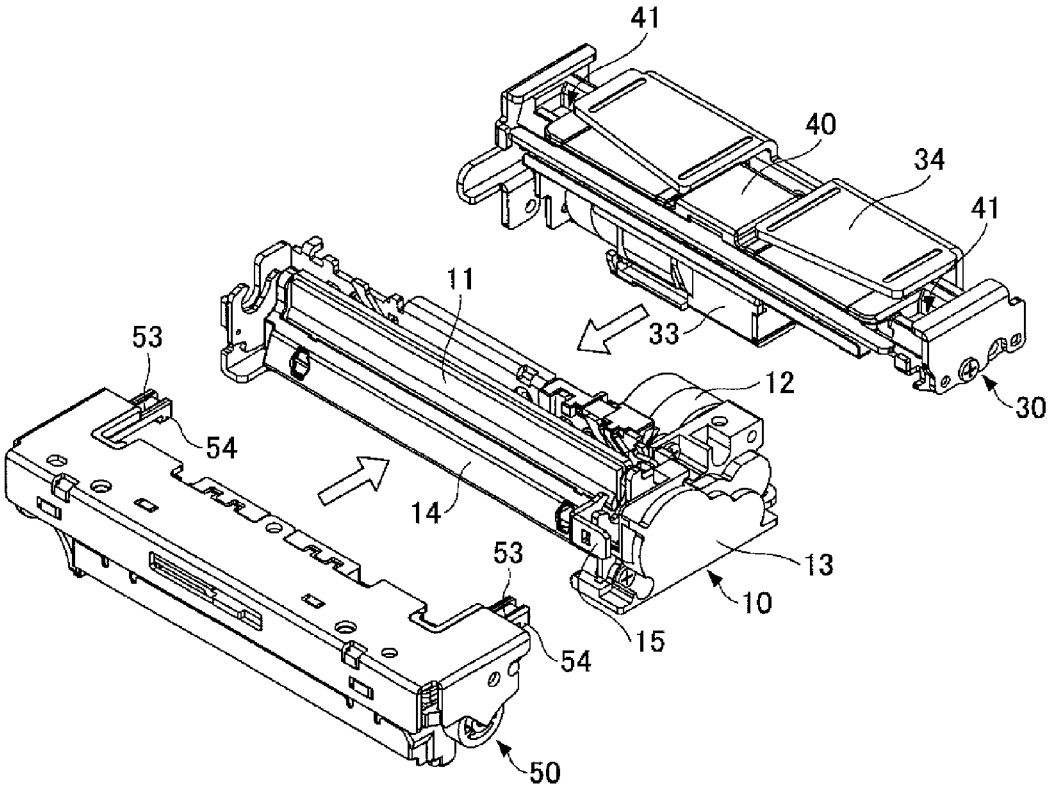
FIG. 3 is an exploded perspective view (1) of a printer.
Figure 4:
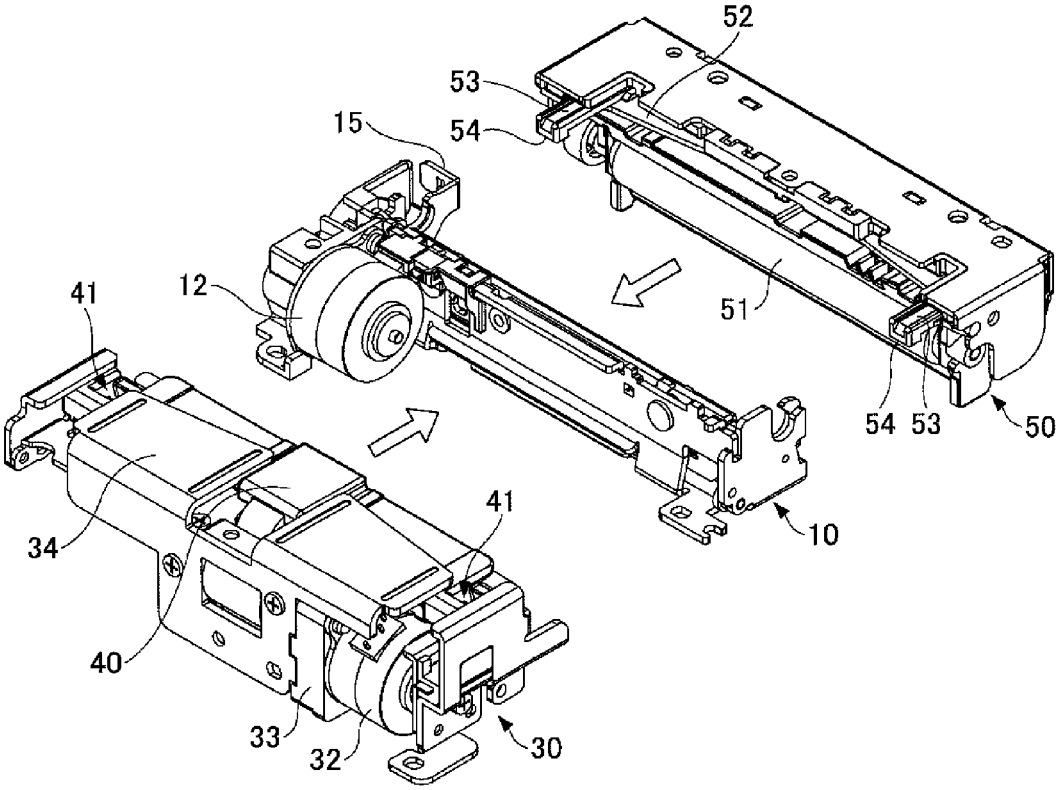
FIG. 4 is an exploded perspective view (2) of a printer.
Figure 5:
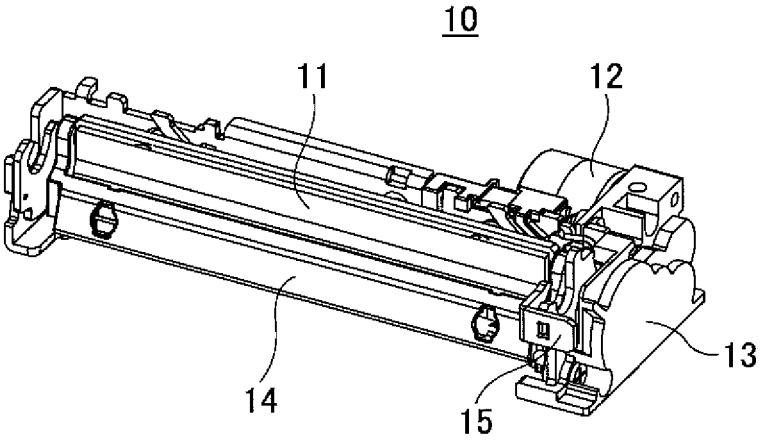
FIG. 5 is a perspective view of a main block of a printer.
Figure 6:
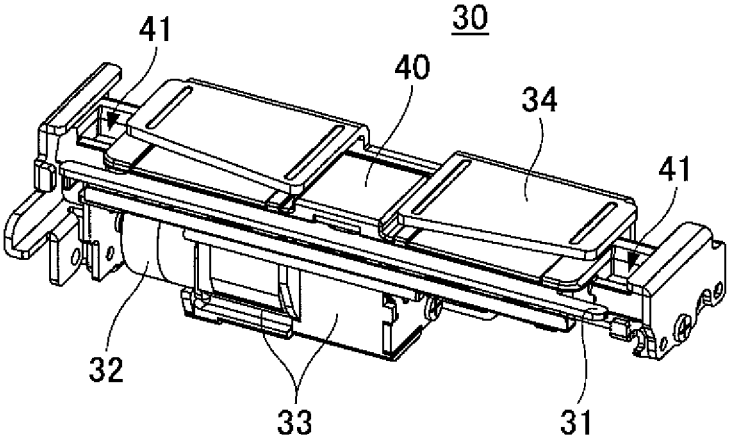
FIG. 6 is a perspective view of a fixed blade block of a printer.
Figure 7:
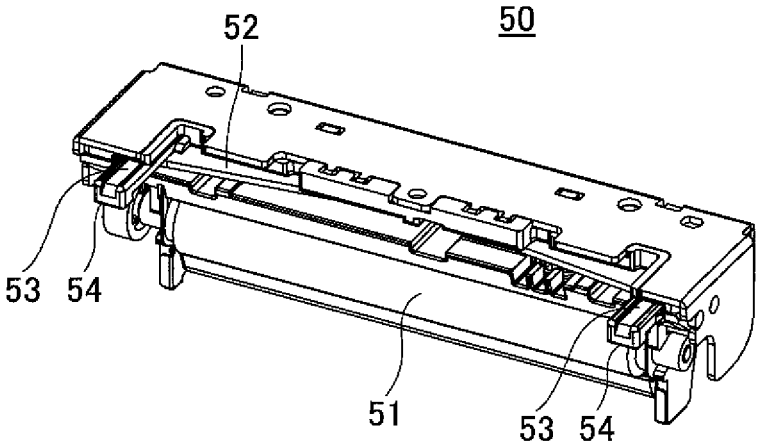
FIG. 7 is a perspective view of a movable blade block of a printer.

An exemplary configuration of a printer according to an embodiment of the present invention is described below. As illustrated by FIGS. 1 through 7, the printer of the present embodiment includes a main block 10, a fixed blade block 30, and a movable blade block 50. The main block 10 and the fixed blade block 30 are detachably connected to each other. Also, the main block 10 and the fixed blade block 30 are detachably connected to the movable blade block 50. FIG. 1 is a front perspective view and FIG. 2 is a rear perspective view of the printer. FIG. 3 is a front exploded perspective view and FIG. 4 is a rear exploded perspective view of the printer. FIG. 5 is a perspective view of the main block 10, FIG. 6 is a perspective view of the fixed blade block 30, and FIG. 7 is a perspective view of the movable blade block 50.

The main block 10 includes a thermal head 11 that is an example of a print head for printing information on a recording medium such as paper, a feeding motor 12 for feeding the recording paper, a feeding gear box 13 for transmitting the driving force of the feeding motor 12, a paper guide 14 for guiding the paper in a predetermined direction, and a lever 15 for disconnecting the movable blade block 50 from the main block 10.

The fixed blade block 30 includes a fixed blade 31, a cutter motor 32, a cutter gear box 33, a fixed blade block cover 34, and a sliding mechanism 40. The cutter motor 32 is connected to the cutter gear box 33, and the cutter gear box 33 is connected to the sliding mechanism 40. When the cutter motor 32 is driven, the sliding mechanism 40 is caused to move in a linear direction via the cutter gear box 33. More specifically, the sliding mechanism 40 slides backward when the cutter motor 32 is rotated in one direction, and the sliding mechanism 40 slides forward when the cutter motor 32 is rotated in the other direction. The width of the sliding mechanism 40 is wider than the width of recording paper. Recesses 41 are formed at the corresponding ends of the sliding mechanism 40. One or more grooves for guiding the sliding movement of the sliding mechanism 40 may be formed in the sliding mechanism 40. In the present embodiment, a stepping motor is used as the cutter motor 32. The cutter motor 32 may be referred to as a "cutter driving part".

The movable block 50 includes a platen roller and a movable blade 52. Connecting parts 53 are provided at the corresponding ends of the movable blade 52. The connecting parts 53 extend in a direction of movement of the movable blade 52. A protrusion 54 is formed at an end of each of the connecting parts 53. The protrusion 54 is to be fitted into or placed in the corresponding recess 41 of the sliding mechanism 40 of the fixed blade block 30. Accordingly, the number of the protrusions 54 corresponds to the number of recesses 41. Although the connecting parts 53 include the protrusions 54 and the sliding mechanism 40 includes the recesses 41 in the above example, any other configuration may be used to make the sliding mechanism 40 and the connecting parts 53 engage each other. For example, recesses may be formed in the connecting parts 53 and protrusions may be formed on the sliding mechanism 40.

In the printer of the present embodiment, the sliding mechanism 40 for moving the movable blade 52 is disposed above the fixed blade 31, and the cutter gear box 33 is disposed below a substantially central part of the fixed blade 31. Compared with a configuration where a gear box for driving a movable blade is provided on a side of a printer, the above configuration may reduce the width of a printer in the width direction of recording paper and may reduce the size of a printer.

Also in the present embodiment, the movable blade 52 is moved by pulling the movable blade 52 by the sliding mechanism 40. This configuration may make the moving direction of the movable blade 52 stable and reliably cut recording paper with the fixed blade 31 and the movable blade 52.

Figure 8:
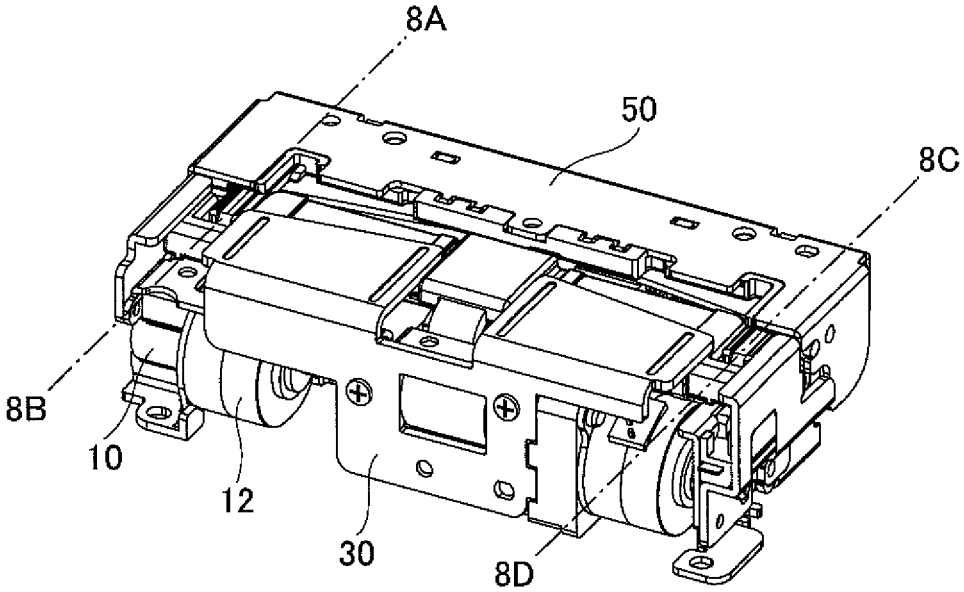
FIG. 8 is a drawing illustrating a printer.
Figure 9:
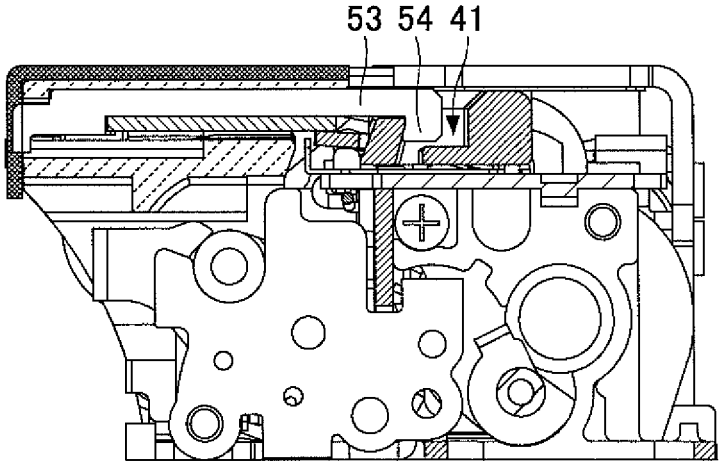
FIG. 9 is a cross-sectional view of a printer taken along line 8A-8B of FIG. 8.
Figure 10:
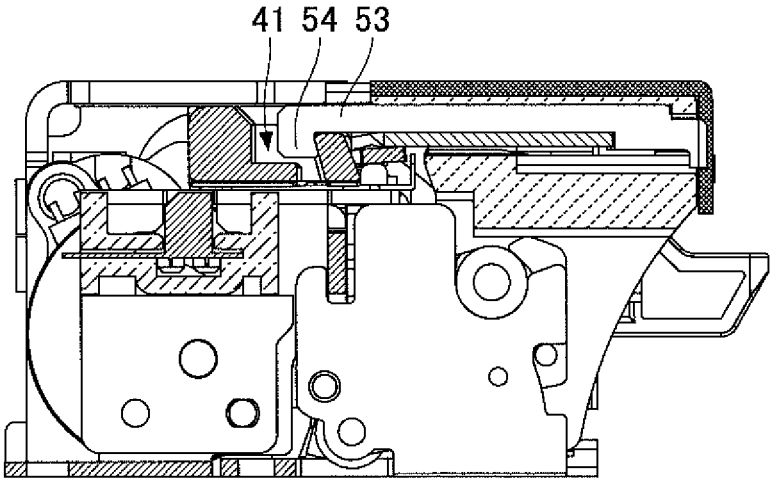
FIG. 10 is a cross-sectional view of a printer taken along line 8C-8D of FIG. 8.

Next, the recesses 41 of the sliding mechanism 40 of the fixed blade block 30 and the protrusions 54 of the movable blade block 50 are described with reference to FIGS. 8 through 10. FIG. 8 is a drawing illustrating the printer where the fixed blade block 30 and the movable blade block 50 are connected to the main block 10. FIG. 9 is a cross-sectional view of the printer taken along line 8A-8B of FIG. 8, and FIG. 10 is a cross-sectional view of the printer taken along line 8C-8D of FIG. 8. As illustrated by FIGS. 8 through 10, when the fixed blade block 30 and the movable blade block 50 are connected to the main block 10, the protrusions 54 of the connecting parts 53 engage with the recesses 41 of the sliding mechanism 40 of the fixed blade block 30. When the sliding mechanism 40 slides while the protrusions 54 of the movable blade block 50 are in the recesses 41 of the sliding mechanism 40, the movable blade 52 of the movable blade block 50 is moved by the sliding movement of the sliding mechanism 40 and recording paper is cut by the movable blade 52 and the fixed blade 31.

<Cutter Motor and Cutter Gear Box>

Figure 11:
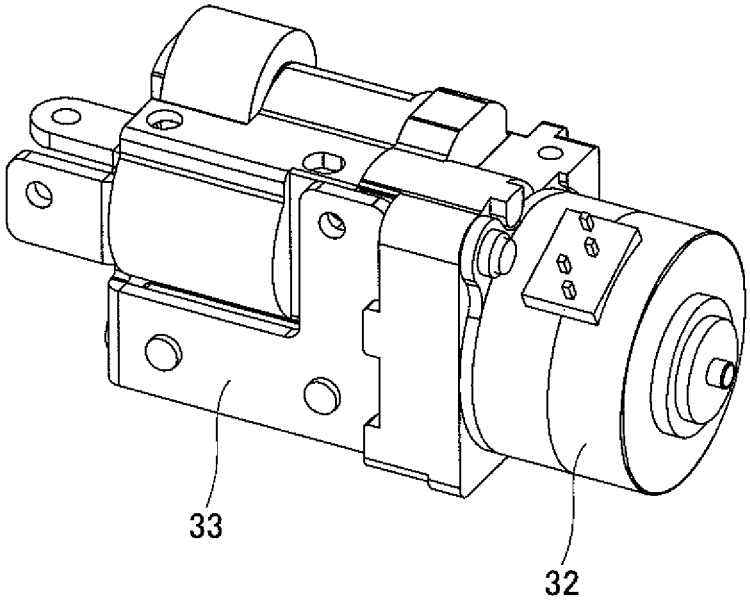
FIG. 11 is an enlarged view of a cutter motor and a cutter gear box.
Figure 12:
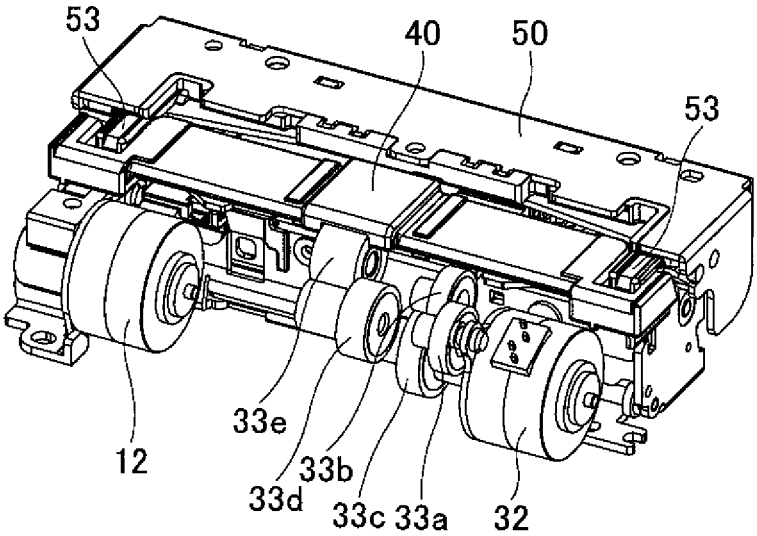
FIG. 12 is a drawing illustrating the inside of a cutter gear box.

The cutter motor 32 and the cutter gear box 33 of the fixed blade block 30 are described below with reference to FIGS. 11 and 12. FIG. 11 is an enlarged view of the cutter motor 32 and the cutter gear box 33, and FIG. 12 is a drawing illustrating the inside of the cutter gear box 33. The cutter gear box 33 includes gears 33*a*, 33*b*, 33*c*, 33*d*, and 33*e*. The rotation of the cutter motor 32 is transmitted via the gears 33*a*, 33*b*, 33*c*, 33*d*, and 33*e* to the sliding mechanism 40 and causes the sliding mechanism 40 to slide.

<Method of Detecting Position of Movable Blade>

Figure 13:
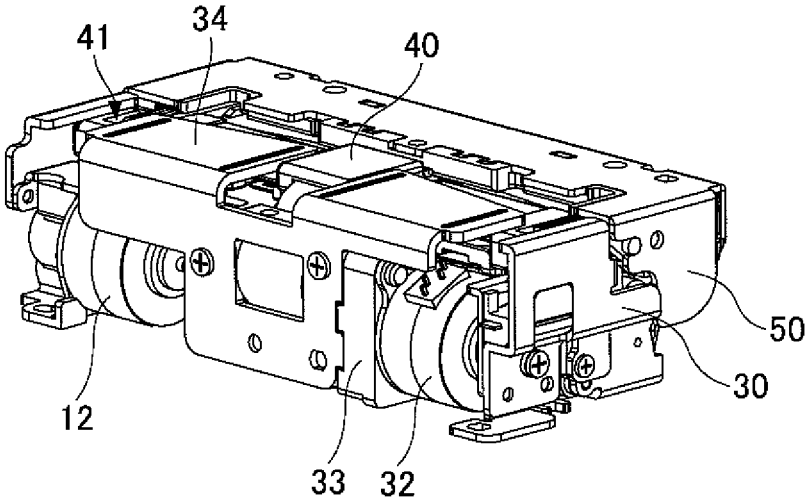
FIG. 13 is a drawing (1) used to describe a method of detecting a position of a movable blade.
Figure 14:
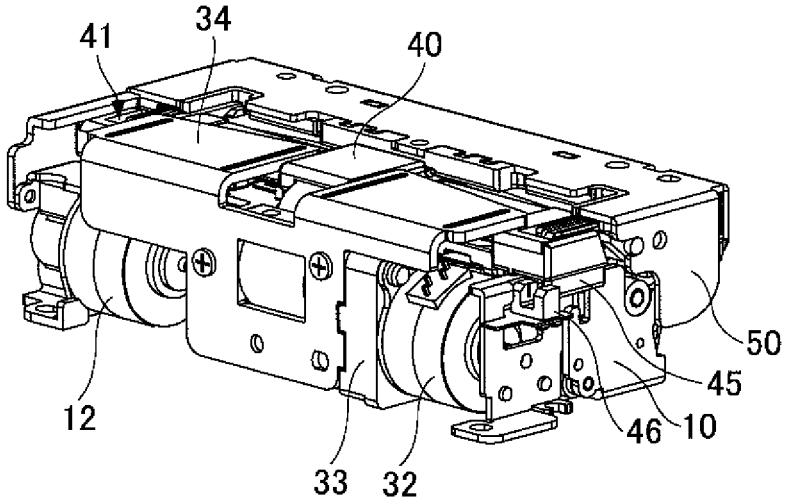
FIG. 14 is a drawing (2) used to describe a method of detecting a position of a movable blade.
Figure 15:
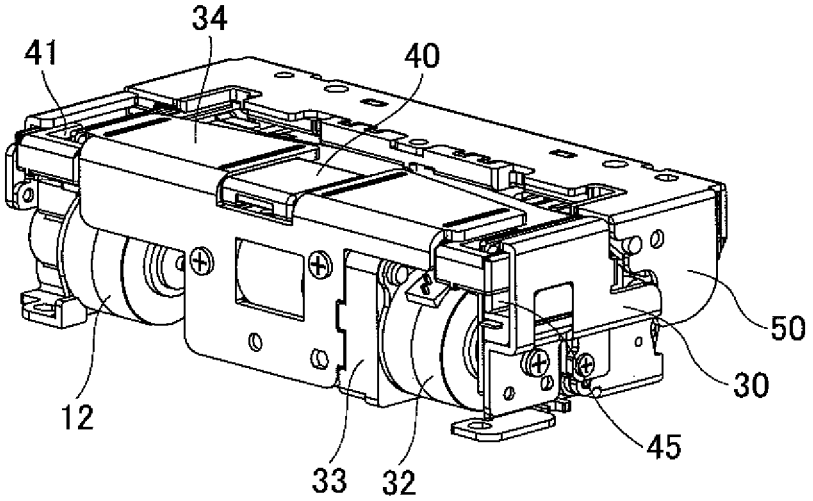
FIG. 15 is a drawing (3) used to describe a method of detecting a position of a movable blade.
Figure 16:
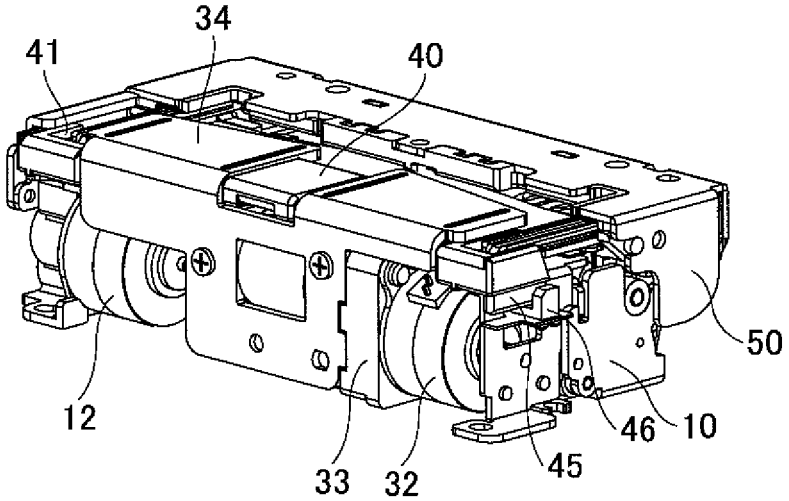
FIG. 16 is a drawing (4) used to describe a method of detecting a position of a movable blade.
Figure 17:
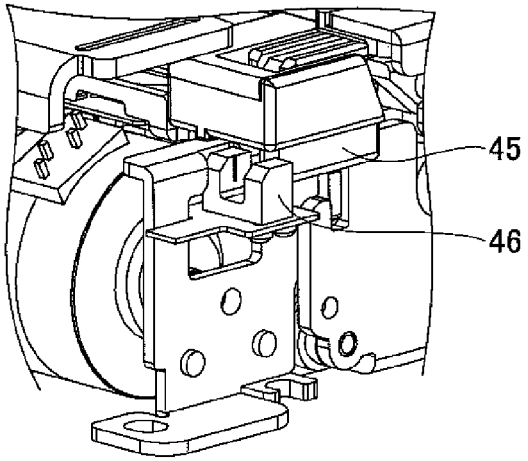
FIG. 17 is an enlarged view of a part of FIG. 14.

An exemplary method of detecting the position of the movable blade 52 is described below with reference to FIGS. 13 through 17. FIG. 13 illustrates a state where the movable blade 52 is at a home position that is the initial position, and FIG. 14 illustrates the printer in the same state with a part of a cover removed. FIG. 15 illustrates a state where the movable blade 52 has been moved to a cutting position at which recording paper is cut, and FIG. 16 illustrates the printer in the same state with a part of the cover removed. FIG. 17 is an enlarged view of a part of FIG. 14.

As illustrated by FIGS. 13 through 17, a sliding position detection protrusion 45 is provided at an end of the sliding mechanism 40. Also, a position detection sensor 46 for detecting a position of the sliding position detection protrusion 45 is provided. The position detection sensor 46 is an optical sensor and includes a light emitting part and a light receiving part. The position detection sensor 46 detects the position of the sliding position detection protrusion 45 based on whether light emitted from the light emitting part enters the light receiving part.

For example, when the light emitted from the light emitting part enters the light receiving part, a controller (not shown) determines that the sliding position detection protrusion 45 is not detected by the position detection sensor 46 and determines that the movable blade 52 is at the home position (and also the sliding mechanism 40 is at a home position). On the other hand, when the light emitted from the light emitting part is blocked by the sliding position detection protrusion 45 and does not enter the light receiving part, the controller determines that the sliding position detection protrusion 45 is detected by the position detection sensor 46 and determines that the movable blade 52 is at the cutting position at which recording paper is cut.

<Lever>

Figure 18:
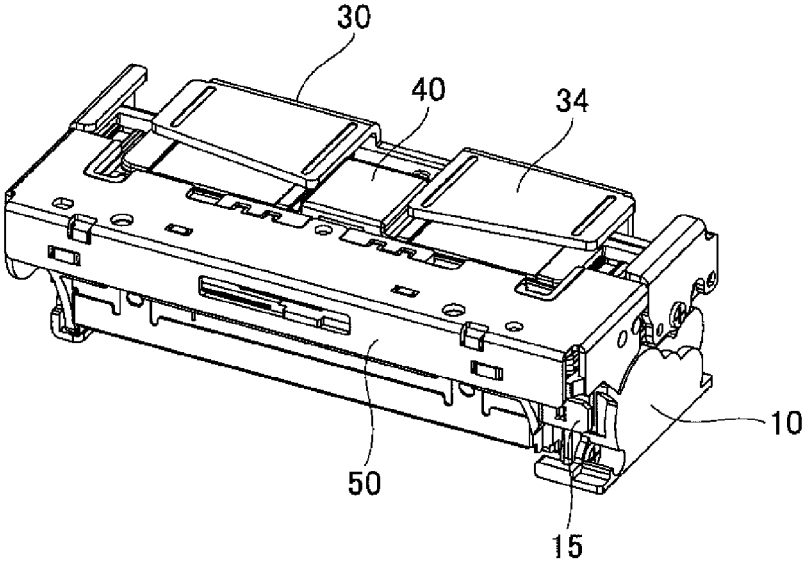
FIG. 18 is a drawing (1) illustrating a lever of a printer.
Figure 19:
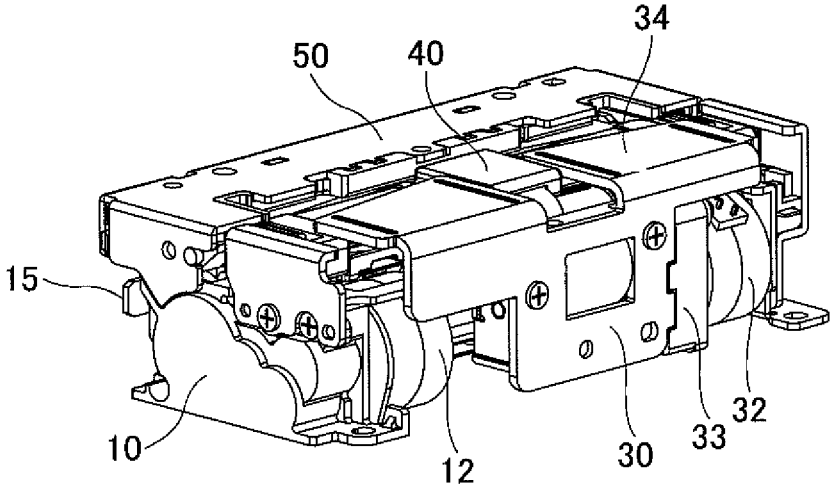
FIG. 19 is a drawing (2) illustrating a lever of a printer.
Figure 20:
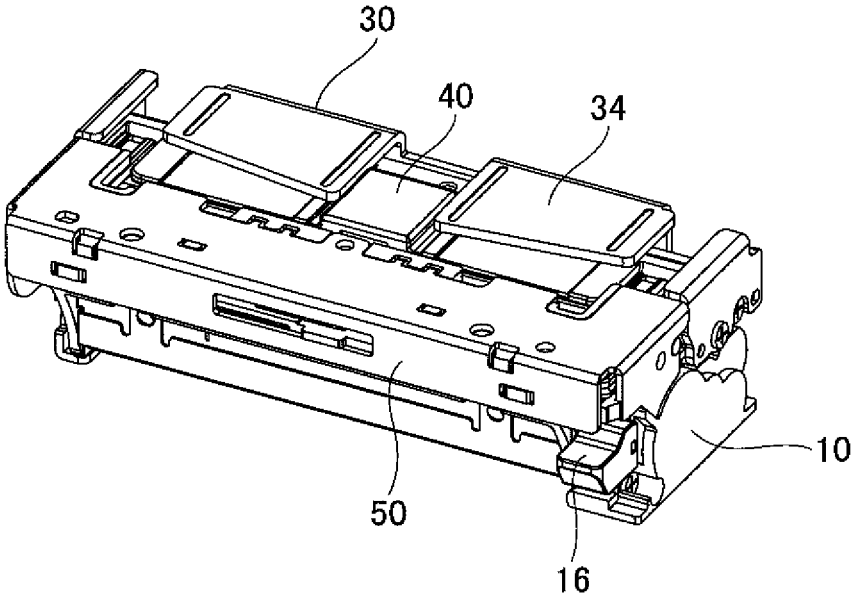
FIG. 20 is a drawing (1) illustrating a lever cap of a printer.
Figure 21:
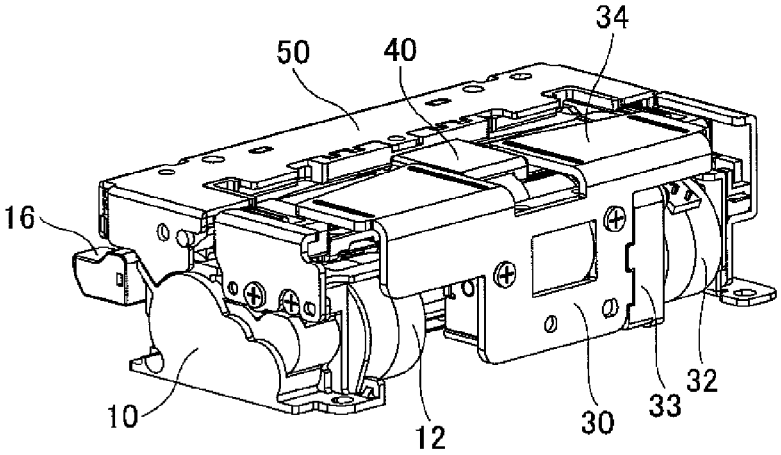
FIG. 21 is a drawing (2) illustrating a lever cap of a printer.

Next, the lever 15 for opening and closing a cover 71 or for disconnecting the movable blade block 50 from the main block 10 and the fixed blade block 30 is described with reference to FIGS. 18 through 21. As illustrated by FIGS. 18 and 19, the printer of the present embodiment includes the lever 15 for disconnecting the movable blade block 50 from the main block 10 and the fixed blade block 30. Also, as illustrated by FIGS. 20 and 21, the printer of the present embodiment includes a lever cap 16 attached to the lever 15. The movable blade block 50 is disconnected from the main block 10 and the fixed blade block 30 by pressing the lever cap 16. FIG. 18 is a front perspective view and FIG. 19 is a rear perspective view of the printer. FIG. 20 is a front perspective view and FIG. 21 is a rear perspective view of the printer.

<Case and Cover>

Figure 22:
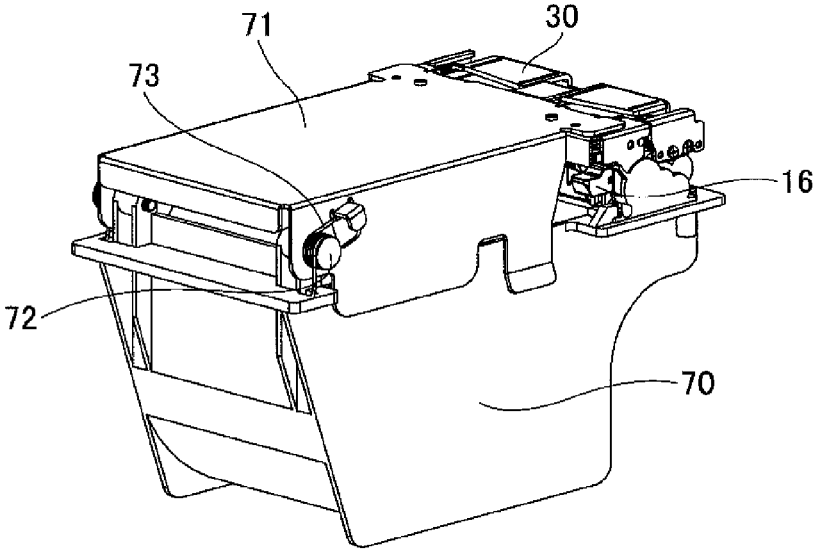
FIG. 22 is a drawing (1) illustrating a printer attached to a case and a cover.
Figure 23:
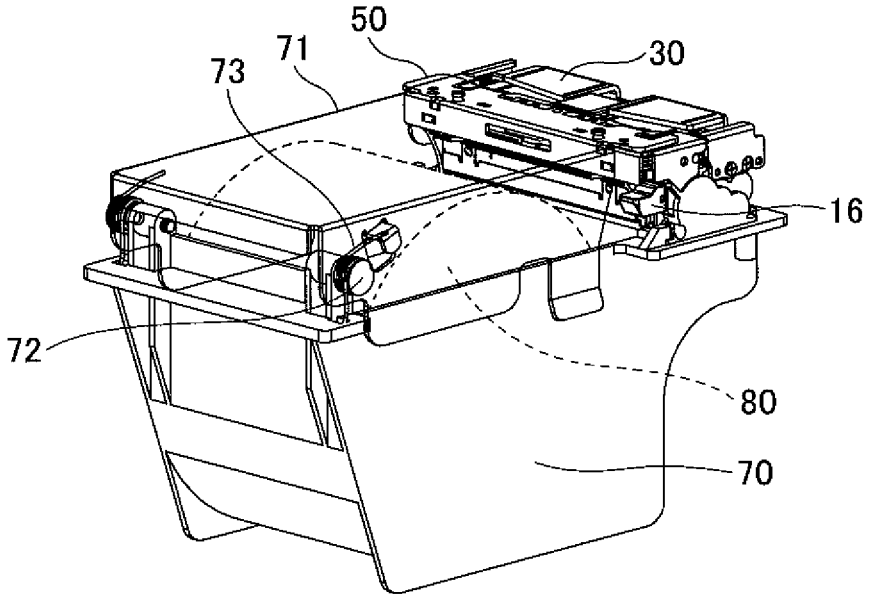
FIG. 23 is a drawing (2) illustrating a printer attached to a case and a cover.
Figure 24:
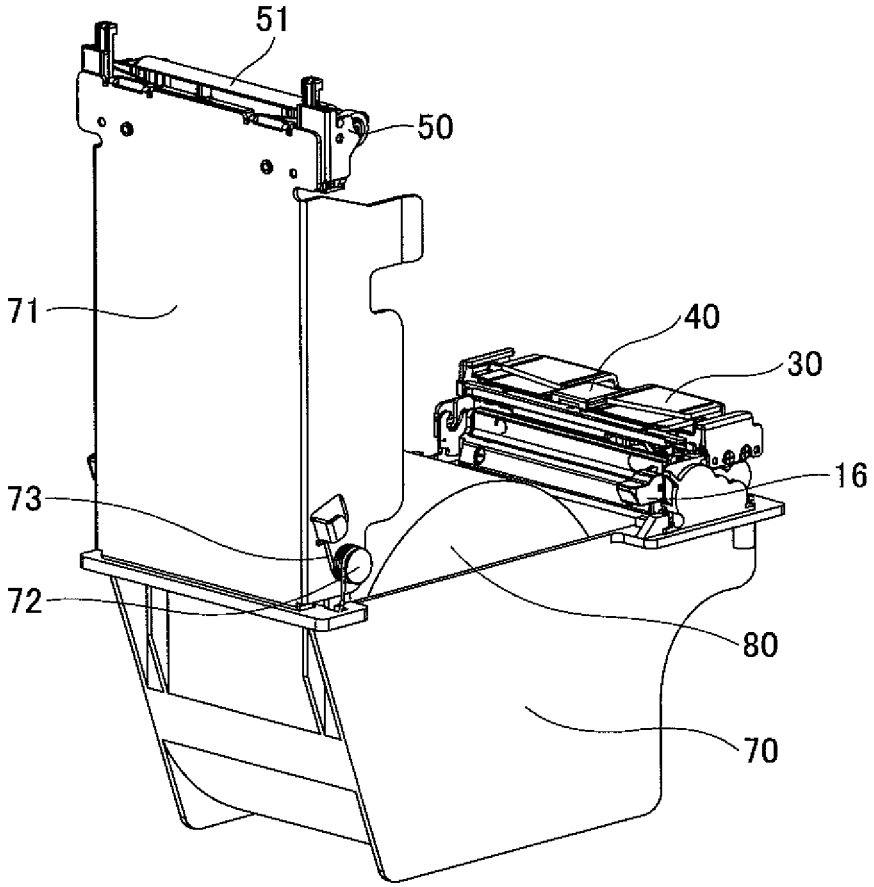
FIG. 24 is a drawing (3) illustrating a printer attached to a case and a cover.
Figure 25:
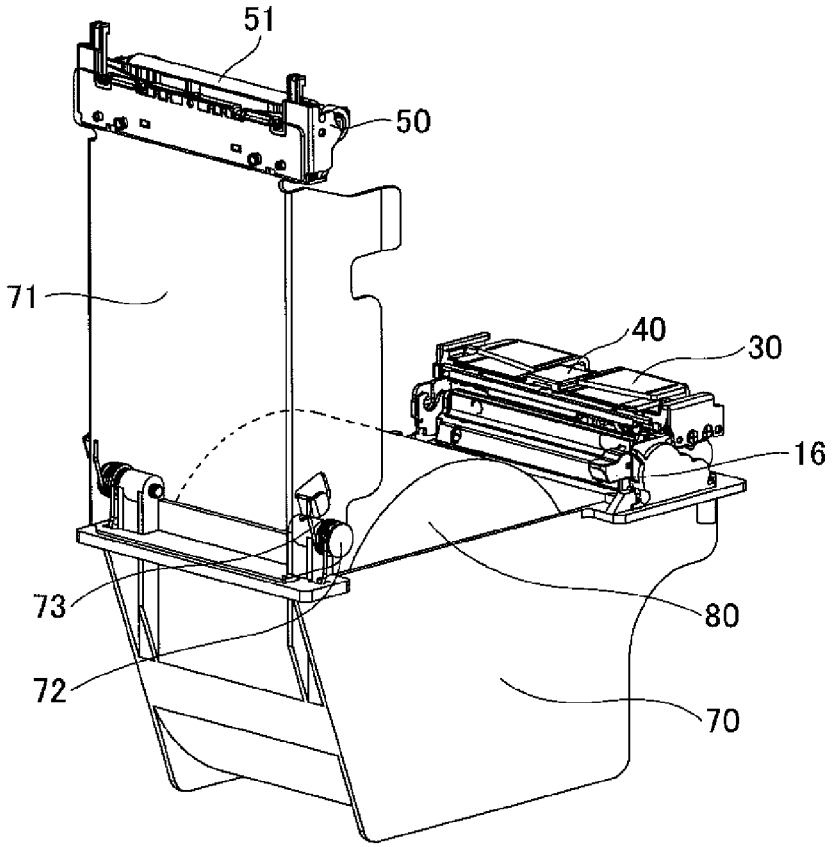
FIG. 25 is a drawing (4) illustrating a printer attached to a case and a cover.

Next, a case 70 for housing recording paper and a cover 71 are described with reference to FIGS. 22 through 25. According to the present embodiment, the printer is attached to the case 70 and the cover 71. In FIGS. 22 through 25, the lever cap 16 is provided for the lever 15. FIG. 22 illustrates a state where the cover 71 is closed, and FIG. 23 illustrates the same state with the cover 71 made transparent. FIG. 24 illustrates a state where the cover 71 is open, and FIG. 25 illustrates the same state with the cover 71 made transparent.

As illustrated by FIGS. 22 through 25, a roll of recording paper 80 is placed in the case 70, and the cover 71 is attached to the case 70 such that the cover 71 is rotatable about a rotational shaft 72. Thus, the cover 71 can be opened and closed by rotating the cover about the rotational shaft 72. A spring 73 is provided near the rotational shaft 72. The spring 73 exerts a force (restoring force) in a direction to open the cover 71. The main block 10 and the fixed blade block 30 are attached to the case 70, and the movable blade block 50 is attached to the cover 71.

As illustrated by FIGS. 22 and 23, with the cover 71 closed, the movable blade block 50 is connected to the main block 10 and the fixed blade block 30, and the printer can print information on the recording paper 80.

When the lever 15 of the main block 10 is pressed via the lever cap 16, the movable blade block 50 is disconnected from the main block 10 and the fixed blade block 30, and the cover 71 is rotated about the rotational shaft 72 and opened by the restoring force of the spring 73. As a result, the platen roller 51 of the movable blade block 50 attached to the cover 71 moves away from the thermal head 11. Thus, by opening the cover 71, it becomes possible to replace the recording paper 80.

In the present embodiment, the rotational shaft 72 is provided such that the movable blade block 50 is movable away from the main block 10 and the fixed blade block 30. Alternatively, a rotational shaft may be provided such that the main block 10 and the fixed blade block 30 are movable away from the movable blade block 50.

<Process of Cutting Recording Paper>

Figure 26:
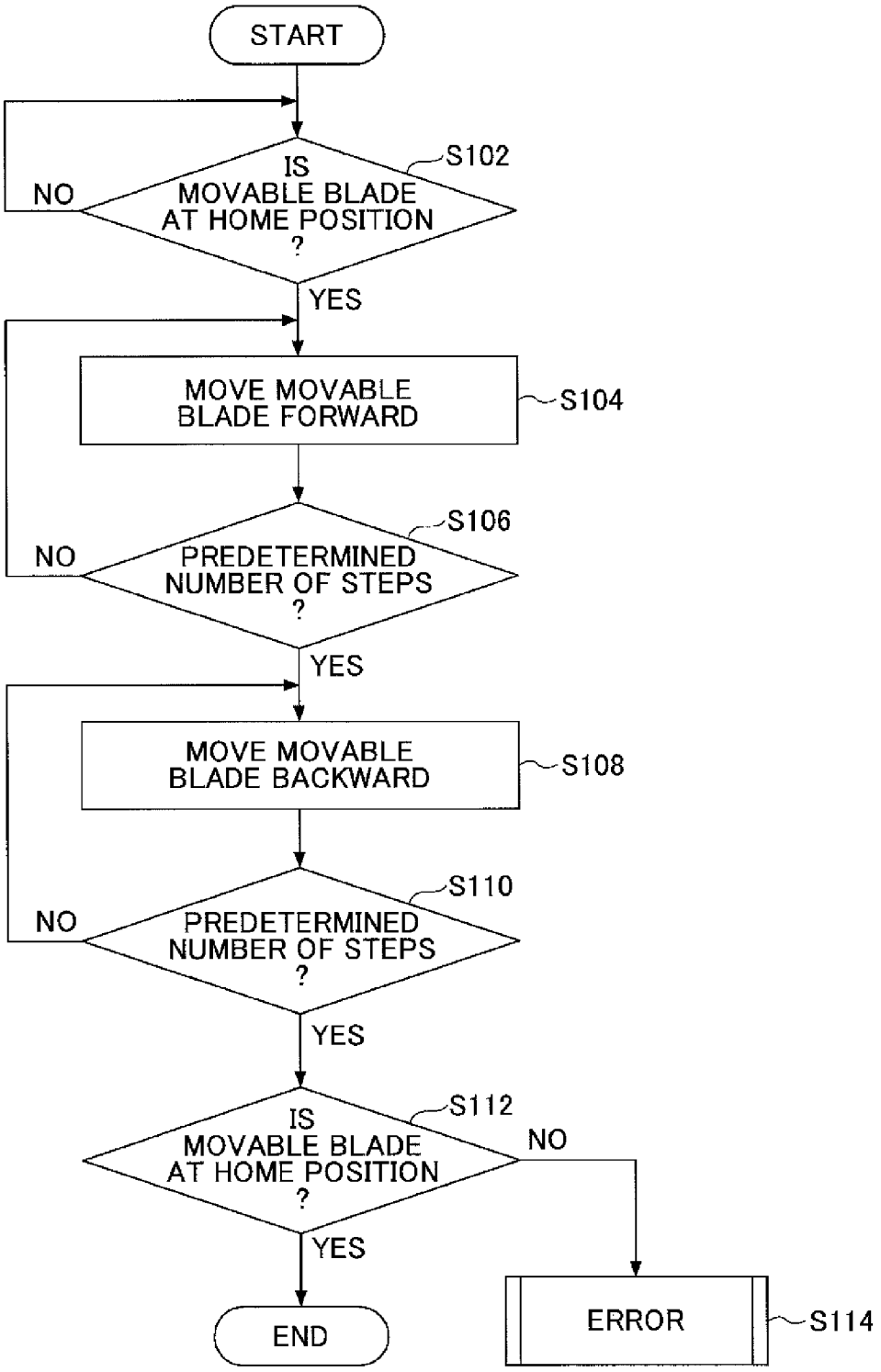
FIG. 26 is a flowchart illustrating a method of cutting recording paper.

Next, an exemplary process of cutting recording paper with the printer of the present embodiment is described with reference to FIG. 26. In the present embodiment, the process is controlled by a controller (not shown) of the printer or an external apparatus. The controller may be implemented, for example, by a central processing unit (CPU) and a memory storing a program for causing the CPU to perform the process.

At step S102, the controller determines whether the movable blade 52 (or the sliding mechanism 40) is at the home position. When the printer is turned on and an initialization process for the movable blade is performed, the controller determines whether the movable blade 52 is at the home position based on whether the sliding position detection protrusion 45 provided at an end of the sliding mechanism 40 is detected by the position detection sensor 46. When the sliding position detection protrusion 45 is not detected by the position detection sensor 46, the controller determines that the movable blade 52 (or the sliding mechanism 40) is at the home position and proceeds to step S104. On the other hand, when the sliding position detection protrusion 45 is detected by the position detection sensor 46, the controller determines that the movable blade 52 is not at the home position and returns to step S104. In this case, the initialization process for the movable blade 52 may be performed again.

At step S104, the controller causes the movable blade 52 to move forward. More specifically, the controller causes the cutter motor 32 to rotate in a first direction and causes the sliding mechanism 40, through the cutter gear box 33, to move in a direction away from the movable blade block 50. When the sliding mechanism 40 moves in a direction away from the movable blade block 50, because the protrusions 54 of the connecting parts 53 provided at the ends of the movable blade 52 are placed in the recesses 41 of the sliding mechanism 40, the movable blade 52 is pulled in a direction toward the fixed blade 31 (i.e., forward direction), and the recording paper is cut by the fixed blade 31 and the movable blade 52

At step S106, the controller determines whether the cutter motor 32 has rotated a predetermined number of steps in the first direction. That is, the controller determines whether the cutter motor 32 has rotated a number of steps that is necessary to cut the recording paper with the fixed blade 31 and the movable blade 52. When the controller determines that the cutter motor 32 has rotated the predetermined number of steps in the first direction, the controller proceeds to step S108. On the other hand, when the controller determines that the cutter motor 32 has not rotated the predetermined number of steps in the first direction, the controller returns to step S104.

At step S108, the controller causes the movable blade 52 to move backward. More specifically, the controller causes the cutter motor 32 to rotate in a second direction that is opposite to the first direction and causes the sliding mechanism 40 to move in a direction toward the movable blade block 50. The protrusions 54 of the connecting parts 53 provided at the ends of the movable blade 52 are placed in the recesses 41 of the sliding mechanism 40, and a return spring (not shown) is provided in the movable blade block 50. Therefore, when the sliding mechanism 40 moves in a direction toward the movable blade block 50, the movable blade 52 is caused to move in a direction away from the fixed blade 31 (i.e., backward direction) and returns to the home position.

At step S110, the controller determines whether the cutter motor 32 has rotated the predetermined number of steps in the second direction. That is, the controller determines whether the cutter motor 32 has rotated a number of steps that is necessary for the movable blade 52 to return to the home position after cutting the recording paper. When the cutter motor 32 has rotated the predetermined number of steps in the second direction, the controller proceeds to step S112. On the other hand, when the cutter motor 32 has not rotated the predetermined number of steps in the second direction, the controller returns to step S108.

At step S112, the controller determines whether the movable blade 52 (or the sliding mechanism 40) is at the home position. The controller determines whether the movable blade 52 is at the home position based on whether the sliding position detection protrusion 45 provided at an end of the sliding mechanism 40 is detected by the position detection sensor 46. When the sliding position detection protrusion 45 is not detected by the position detection sensor 46, the controller determines that the movable blade 52 is at the home position and terminates the process. On the other hand, when the sliding position detection protrusion 45 is detected by the position detection sensor 46, the controller determines that the movable blade 52 is not at the home position and proceeds to step S114.

At step S114, the controller determines that an error has occurred in the process and displays, for example, an error message on a display unit (not shown). When a lock lever (e.g., the lock lever 15) is pressed, for example, in response to the error message, the protrusions 54 are released from the recesses 41. The printer includes a spring (not shown) that pulls the movable blade 52 toward the home position. The movable blade 52 moves toward the home position by the spring when the protrusions 54 are released from the recesses 41. When the lock is unlocked, a lock detection switch (not shown) detects that the lock lever has been pressed or the protrusions 54 have been released from the recesses 41, and outputs an unlock signal indicating the condition where the protrusions 54 are released from the recesses 41. When detecting the unlock signal, the controller drives the cutter motor 32 to cause the sliding mechanism 40 to return to the home position.

A printer according to embodiments is described above. However, the present invention is not limited to the disclosed embodiments, and variations and modifications may be made without departing from the scope of the present invention.

What is claimed is:

1. A printer, comprising:

a print head that prints information on a recording medium;

a fixed blade;

a sliding mechanism that is slidable relative to the fixed blade;

a movable blade that moves according to the sliding movement of the sliding mechanism; and a cutter driving part that causes the sliding mechanism to slide to move the movable blade, wherein the fixed blade, the sliding mechanism, and the cutter driving part are disposed on one side of the print head;

the movable blade is disposed on another side of the print head to face the fixed blade, the sliding mechanism, and the cutter driving part across the print head; and the sliding mechanism is configured to slide in a direction away from the movable blade to pull the movable blade toward the fixed blade.

2. The printer as claimed in claim 1, further comprising:

connecting parts each provided at a side end of the movable blade and extends in a direction in which the movable blade moves, wherein the connecting parts engage with the sliding mechanism so that the movable blade moves along with the sliding movement of the sliding mechanism.

3. The printer as claimed in claim 2, wherein one of the connecting part and the sliding mechanism includes a protrusion formed at ends thereof;

wherein the other of the connecting part and the sliding mechanism includes a recess that is formed therein and correspond to the protrusion of the one of the connecting part and the sliding mechanism; and wherein the protrusion engages with the recess.

4. The printer as claimed in claim 1, further comprising:

a platen roller, wherein the fixed blade, the cutter driving part, and the sliding mechanism are provided on a fixed blade block;

the movable blade and the platen roller are provided on a movable blade block; and the fixed blade block and the movable blade block are connected to each other.

5. The printer as claimed in claim 4, further comprising:

a gear box that is provided on the fixed blade block and transmits a driving force of the cutter driving part to the sliding mechanism.

6. The printer as claimed in claim 1, further comprising:

a platen roller, wherein the print head is provided on a main block;

the fixed blade, the cutter driving part, and the sliding mechanism are provided on a fixed blade block;

the movable blade and the platen roller are provided on a movable blade block; and the main block, the fixed blade block, and the movable blade block are connected to each other.

7. The printer as claimed in claim 6, further comprising:

a case that houses the recording medium; and a cover that is attached to the case and is rotatable to open and close the cover, wherein the main block and the fixed blade block are attached to the case, and the movable blade block is attached to the cover.

8. The printer as claimed in claim 7, wherein when the cover is closed, the movable blade block is connected to the main block and the fixed blade block; and wherein when the cover is opened, the movable blade block is disconnected from the main block and the fixed blade block.

9. The printer as claimed in claim 1, further comprising:

a position detection sensor for detecting a position of the sliding mechanism, wherein the sliding mechanism includes a detection protrusion; and the position detection sensor detects the detection protrusion.

10. The printer as claimed in claim 9, wherein when it is determined that the sliding mechanism is not at a home position based on a detection result of the position detection sensor and an unlock signal is detected, the printer causes the sliding mechanism to return to the home position.

11. A printer, comprising:

a main block including a print head that prints information on a recording medium;

a fixed blade block that is detachably attached to the main block and includes a fixed blade, a sliding mechanism that is slidable relative to the fixed blade, a cutter driving part that causes the sliding mechanism to slide, and a transmission that transmits driving force of the driving part to the sliding mechanism; and a movable blade block that is detachably attached to the main block and includes a movable blade that moves toward and away from the fixed blade according to sliding movement of the sliding mechanism included in the fixed blade block.

12. The printer as claimed in claim 11, wherein when the movable blade block is in a closed position, the movable blade engages with the sliding mechanism.

13. The printer as claimed in claim 11, further comprising:

a feed driving part that drives a feeding mechanism for feeding the recording medium; and a feeding transmission that transmits driving force of the feed driving part to the feeding mechanism, wherein the feed driving part and the feeding transmission are provided on the main block.

14. A printer, comprising:

a print head;

a fixed blade block that includes a fixed blade;

a movable blade block detachably engages with the fixed blade block;

a movable blade provided on the movable blade block, that is slidable toward and away from the fixed blade;

a sliding mechanism provided on the fixed blade block, that is slidable toward and away from the movable blade block; and a driving part provided on the fixed blade block, for driving the sliding mechanism to slide, wherein the movable blade slides toward and away from the fixed blade according to sliding movement of the sliding mechanism.

* * * * *